US007340870B2

(12) United States Patent
Roger

(10) Patent No.: US 7,340,870 B2
(45) Date of Patent: Mar. 11, 2008

(54) DUPLEX BAG

(75) Inventor: Anthony Roger, Sartrouville (FR)

(73) Assignee: S2F Flexico, Henonville (FR)

( * ) Notice: Subject to any disclaimer, the term of this patent is extended or adjusted under 35 U.S.C. 154(b) by 102 days.

(21) Appl. No.: 10/504,045

(22) PCT Filed: Feb. 4, 2003

(86) PCT No.: PCT/FR03/00333

§ 371 (c)(1),
(2), (4) Date: Apr. 25, 2005

(87) PCT Pub. No.: WO03/066318

PCT Pub. Date: Aug. 14, 2003

(65) Prior Publication Data

US 2006/0089243 A1 Apr. 27, 2006

(30) Foreign Application Priority Data

Feb. 5, 2002 (FR) ..... 02 01328

(51) Int. Cl.
*B65B 3/02* (2006.01)

(52) U.S. Cl. ..... 53/452; 53/133.4; 53/139.2; 493/213; 493/394; 493/927

(58) Field of Classification Search ..... 53/452, 53/473, 133.4, 139.2; 493/213, 114, 325, 493/394, 927, 194, 199
See application file for complete search history.

(56) References Cited

U.S. PATENT DOCUMENTS 4,335,817 A 6/1982 Bahr
5,167,455 A * 12/1992 Forman ..... 383/66
5,167,608 A * 12/1992 Steffens et al. ..... 493/214
5,221,143 A 6/1993 Peppiatt
5,461,845 A * 10/1995 Yeager ..... 53/451
5,776,044 A 7/1998 Clark
5,902,047 A * 5/1999 Yeager ..... 383/203
6,019,512 A * 2/2000 Yeager ..... 383/203
6,079,878 A * 6/2000 Yeager ..... 383/203
6,224,262 B1 * 5/2001 Hogan et al. ..... 383/203
6,652,436 B1 * 11/2003 Yeager et al. ..... 493/213

FOREIGN PATENT DOCUMENTS

EP 0843636 10/1995
GB 2127678 4/1984

* cited by examiner

*Primary Examiner*—Sameh H. Tawfik
(74) *Attorney, Agent, or Firm*—Blakely Sokoloff Taylor & Zafman

(57) ABSTRACT

A method for manufacturing double ply packaging bags includes feeding a first packaging web, the first packaging web including a window patch that is cut out or pre-cut, feeding a second packaging web, the second packaging web including another window patch that is cut out or pre-cut, applying a fastener assembly to a fed-through packaging web, perpendicular to a window patch, attaching the fastener assembly to the packaging web, attaching the two packaging webs to each other to form a double ply web, and forming a double ply packaging bag with the double ply web. The double ply packaging bag has a front wall and a back wall, where the front wall and the back wall are each formed by the double ply web.

23 Claims, 3 Drawing Sheets

---Prior Art---

DUPLEX BAG

The present patent application is a non-provisional application of International Application No. PCT/FR2003/000333, filed Feb. 4, 2003.

BACKGROUND

1. Field of the Invention

The invention relates to the field of packaging bags.

2. Description of Related Art

Numerous packaging bags and numerous systems for manufacturing them have already been proposed.

For thin bags, usually flat, in a filled state, the known means give overall satisfaction. In this case, the bags are generally made from two flat webs welded together along three sides and bearing means for sealing, for example complementary male/female sections at the opening of the bags.

On the other hand until now, the making of bags for bulky items, irrespective of their nature, has proved unsatisfactory, despite numerous studies in this very specific field.

In particular, such bags often require relatively thick walls, and it is not easy to attach means for sealing to such walls.

This applying of the means for sealing is all the more delicate when the means for applying are not located at the opening of the packaging bag, but on a surface of the bag.

We have diagrammatically illustrated in the annexed FIG. 1 a known technique for manufacturing bags comprising means for sealing 5 attached to a wall 3 of the packaging bag 1, and not at the opening 2 of the packaging bag.

The means for sealing 5 are welded or stuck to points 6 on the front wall 3 of the bag 1.

The points of application are made on the means for applying 7 of the means for sealing 5. These means for applying 7 comprise films, for example made in plastic.

The means for sealing 5 can also comprise means 8 forming runners facilitating the opening and closing of the means for sealing 5.

Examples of such known bags are disclosed and illustrated in documents U.S. Pat. No. 4,335,817 and EP 0 843 636.

The bags, according to the prior art, however, comprise inconveniences.

Notably, the points of application 6 are not entirely sound.

Such bags do not envisage the applying of means for applying on bags comprising double-layer walls, that meaning double ply bags.

BRIEF SUMMARY OF THE INVENTION

The invention proposes to overcome these inconveniences.

For this reason the invention proposes a method for manufacturing double-ply packaging bags comprising:

feeding a first packaging web, the first packaging web on which a window patch is cut out or pre-cut;

feeding a second packaging web, the second packaging web on which another window patch is cut or pre-cut;

a fastener assembly is applied to a fed-through packaging web, perpendicular to a window patch;

attaching the fastener assembly to the packaging web;

the two packaging webs are attached to each other to form a double ply web, a double ply packaging bag is then formed with the double ply web, the bag having a front wall and a back wall, the front wall and the back wall being each formed by the double ply web.

The invention is advantageously completed by the following characteristics taken singly or in any technically possible combination:

the set of fasteners is applied between the two packaging webs, so that the means for applying the set of fasteners are incorporated between the two packaging webs;

attaching the set of fasteners to one of the two packaging webs, the double ply formed by the other packaging web not covering the means for applying the set of fasteners;

welding the means for applying the set of fasteners to the packaging web;

sticking the means for applying the set of fasteners to the packaging web;

cutting out at least the window patch intended for the external wall of the double ply bag with a pre-cut dotted line so that the wall of the bag is capable of forming a seal covering the set of fasteners on the front of the bag and being of tamper-proof type prior to the first opening; and applying an adhesive strip opposite the window patch of the external wall, this strip thus constituting a tamper-proof element to be stripped off upon the first opening of the bag.

The invention relates to bags produced by this method as well as the machines for implementing the method according to the invention.

BRIEF DESCRIPTION OF THE DRAWINGS

Other characteristics, purposes and advantages of the invention will be revealed through the description that follows which is clearly illustrative and non restrictive and which must be read in relation to the annexed drawings in which.

DETAILED DESCRIPTION OF THE INVENTION

As previously indicated the invention relates to the producing of re-sealable bags using automatic machines, these bags comprising a double ply wall.

This invention can apply as much to horizontal feed through automatic bag production machines as to vertical feed through automatic bag production machines.

Furthermore, the invention applies as much to automatic bag production machines with filling during a step subsequent to the production and possibly geographically separate from the production site as to production machines with filling and sealing—of "FORM, FILL, SEAL" (FFS) type—on a single site and in successive steps.

Thus the invention preferably and advantageously applies to FFS type vertical feed through machines.

Figure 1:
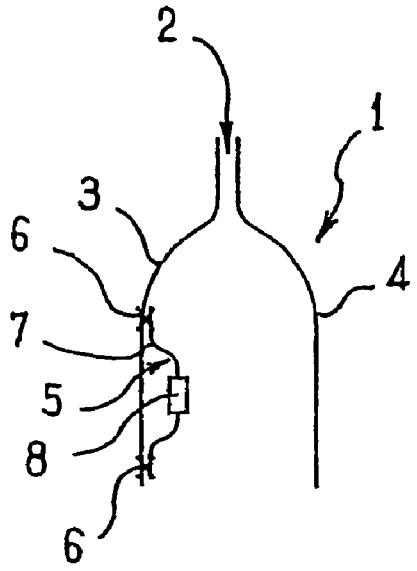
FIG. 1 diagrammatically represents a bag according to the prior art comprising an opening on one single ply wall.
Figure 2:
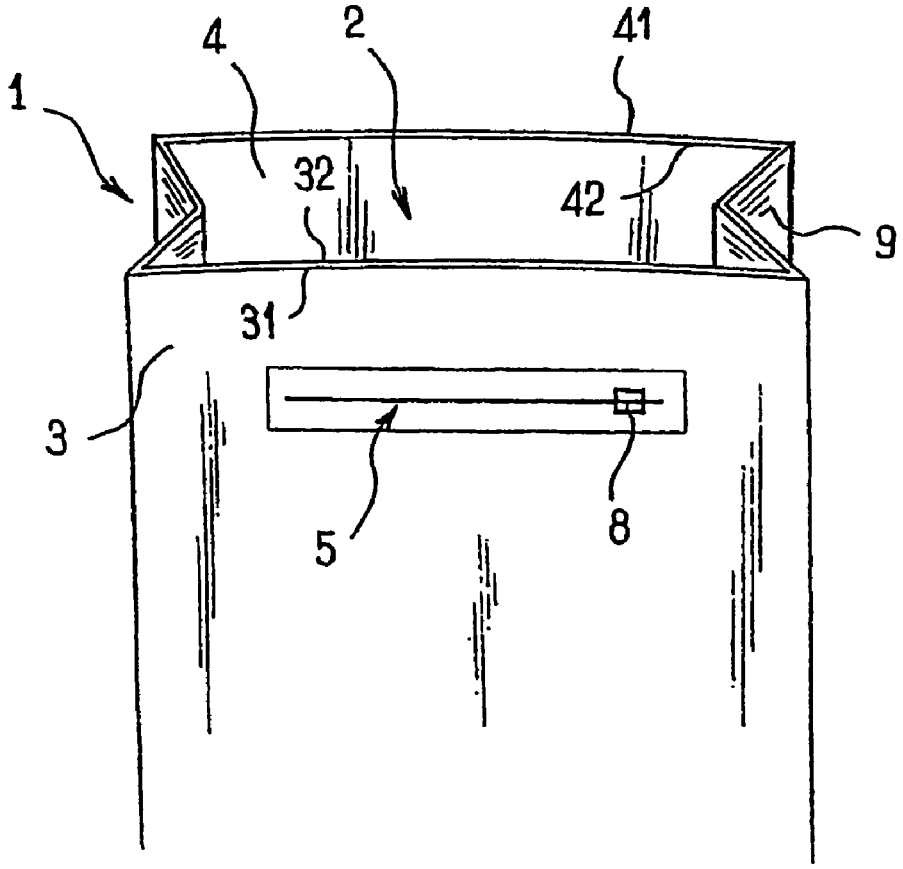
FIG. 2 diagrammatically represents a front view of a double ply bag comprising an opening on one wall of 20 the bag.

We have diagrammatically represented in FIG. 2 a bag 1 intended to receive thick contents, which will be for example inserted into the bag 1 by the opening 2, this bag 1 principally comprising two walls 3 and 4.

Such a bag 1 is formed according to a known technique by the folding on itself of a packaging web so as to form a bag. The bag 1 comprises for example, but not obligatorily, gussets 9 on its sides. We can advantageously refer to the applicant's priority French application FR 2 758 761 in order to understand the forming and producing of such bags.

We have designated the front wall of the bag 1 with 3 and the rear wall of the bag 1 with 4.

The front wall 3 comprises a set of fasteners 5. This set of fasteners 5 comprising, for example but not obligatorily, means 8, facilitating the opening and the closing of the means for sealing the fastener set 5. The means 8 will be for example formed by a runner that can be moved along known complementary sealing sections.

The set of fasteners 5 can also comprise means for sealing that do not comprise male/female type complementary sealing sections.

The set of fasteners can comprise a U-shaped or W-shaped film, or any known shape.

Additionally, the fasteners set 5 can comprise a film covering the means for sealing, and allowing to form a "tamperproof" type film. The film is opened upon the first opening of the bag by the tearing of a line of weakness made in the film material, this line of weakness can comprise dotted lines.

The walls of bag 1 comprise two pieces, called plies. We have designated in FIG. 2 the exterior ply of the wall 3 with 31 and the interior ply of the wall 3 with 32. We have also designated the exterior ply of the wall 4 with 41 and the ply of the wall 4 with 42, the ply 42 being on the inside of the bag 1.

Figure 3:
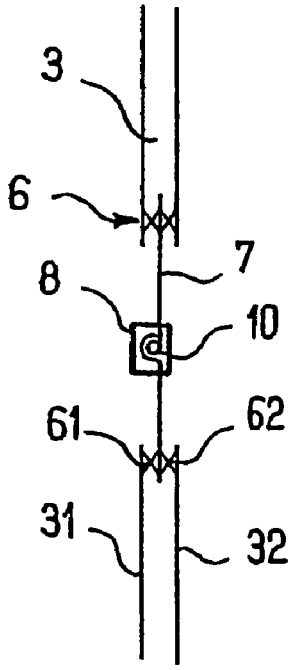
FIG. 3 represents a first method for applying an opening and a set of fastening between the two webs of a wall of a double ply bag.

FIG. 3 diagrammatically represents applying the set of fasteners 5 to the inside of the double ply wall 3.

According to the invention, the set of fasteners 5 comprises means for applying 7. These means for applying 7 will be for example formed by side films, in whatsoever material. The side films can thus be composed of typical material, but also of paper or carton type material.

According to the invention, these means for applying 7 are attached at points 6 to the wall of the bag 1.

The points of application 6 comprise, according to a first embodiment represented in FIG. 3, a first point of application 61 which attaches the means for applying 7 to the ply 31, and a second point of application 62 attaching the means for applying 7 to ply 32.

This embodiment has the advantage over the embodiment of the prior art of allowing the very sound attachment of the set of fasteners 5 to a double ply bag.

In FIG. 3, a set of fasteners 5 is shown comprising means forming male/female type complementary sections 10 as well as means forming the runner 8 allowing to easily open and close these means for sealing 10.

The runner can be in either metal or plastic.

Other means for sealing can obviously be attached to such a wall 3, for example means that do not comprise sealing runners, or means for sealing that do not comprise complementary sections.

Figure 4:
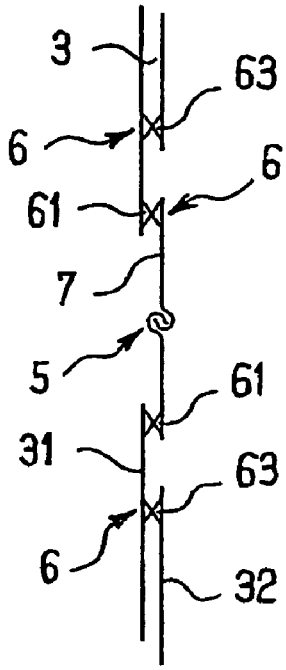
FIG. 4 represents another method for applying means for sealing on a double ply bag.

FIG. 4 represents another embodiment for the attachment of a set of fasteners 5 to a wall 3. According to this embodiment, the wall 3 comprises points of application 6 which are not overlaid. The means for applying the set 5 are attached to ply 31 by a point of application 61, even though they are not attached to ply 32 of the wall 3.

In the embodiment represented in FIG. 3, the ply 32 does not have exactly the same dimensions as ply 31. In other words, the cut-out window patch in ply 32 allowing a user to gain access to the inside of the bag has greater dimensions than the window patch pierced in ply 31 of the bag 1, the latter window patch allowing access to means for sealing the bag.

The ply 32 is attached to ply 31 by points of application indicated by 63 in FIG. 4. FIG. 4 illustrates means for sealing that do not comprise opening and closing runners. The means for sealing comprise male/female type complementary sections, but an alternative to this embodiment comprising means for sealing that do not have such sections is conceivable.

Figure 5:
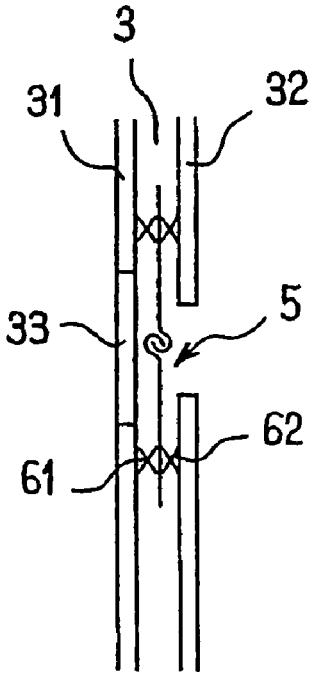
FIG. 5 represents an embodiment where a packaging bag comprises on its surface means for sealing a pre-cut window patch forming a "tamper-proof strip"

FIG. 5 represents an alternative to the embodiment represented in FIG. 3. According to this alternative, the ply 31 does not comprise an opening allowing direct access for the user to the set of fasteners 5. According to this alternative, the window patch 33 is pre-cut out of the ply 31, without being totally open. Thus, the means for fastening 5 are not accessible from the outside of the bag. The pre-cut window patch 33 thus constitutes a "tamper-proof" type seal allowing to indicate to the user that the bag has never been opened.

For the first opening of the bag 1, the user will cut the tamper-proof window patch 33 along the dotted line on the ply 31. For this reason, the dotted line constitutes a line of weakness in the ply 31 allowing to easily open the tamper-proof window patch 33. The pre-cut dotted line can be of another type, for example a line of weakness with a lesser thickness in the case for example of plies made in plastic.

In FIG. 5, the tamper-proof window patch is located on the ply 31. We can also envisage placing a tamper-proof window patch on the ply 32, retaining or not the tamper-proof type window patch on the ply 31.

Figure 6:
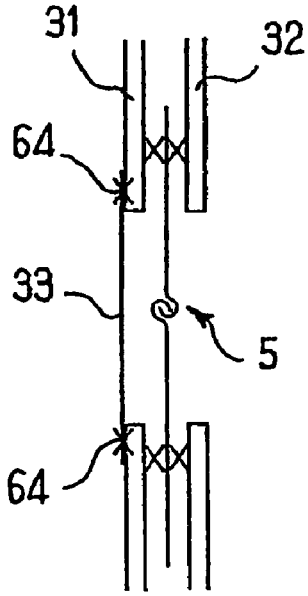
FIG. 6 represents an embodiment where a packaging bag comprises on its surface means for sealing an adhesive strip forming a tamper-proof strip.

FIG. 6 represents another alternative of the bag represented in FIG. 3, according to which the tamper-proof window patch is no longer constituted of a pre-cut window patch on the ply 31, but is constituted of an adhesive strip 33 which is stuck to the perimeter of the window patch open in the ply 31, the stickiness being made via the points of application 64 located on the exterior of the bag.

This relatively strong stickiness allows the forming of a perfect tamper-proof type seal perpendicular to the set 20 of fasteners 5. This adhesive strip 33 can be constituted of a plastic type material.

As in the alternative represented in FIG. 5, this adhesive strip can also be stuck to the wall on the inside of the bag on the ply 32. The choice of an adhesive strip on the ply 31 and/or 32 is made—independently from each other.

also In another embodiment an adhesive strip can be placed, as represented in FIG. 6, on a tamper-proof window patch 30 of the type represented in FIG. 5.

Figure 7:
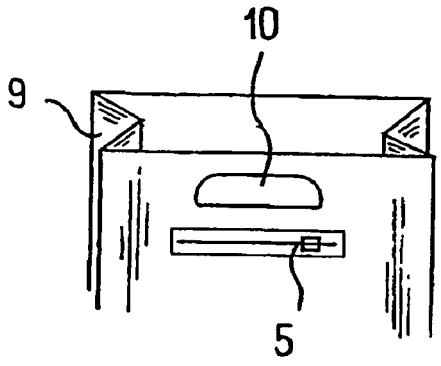
FIG. 7 represents an embodiment in which openings are formed on the upper part of the bag once filled and thus allows to form a grip handle.

FIG. 7 represents a bag according to the invention in which we have pierced two window patches 10 in the upper part allowing to form means for gripping so as to carry the packaging bag.

Figure 8:
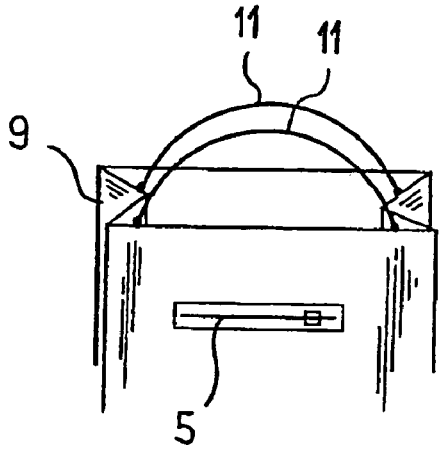
FIG. 8 represents an embodiment according to 5 which the means for gripping are formed by straps attached to the upper part of the packaging bag.

FIG. 8 represents an alternative according to which the means for gripping comprise of straps 11. The attaching of the straps or cords 11 can be ensured via sticking or via stringing said straps in holes made in the upper part of the bag. The stringing is followed by a step in which we stick on the upper part of the bag or we tie the straps in the purposely made holes.

Alternatively, the bag only comprises a single strap or cord forming a handle. The walls of the packaging bag can be indiscriminately made in plastic material, paper or carton type material. The walls can for example be made of an interior ply in a material, the exterior ply being in another material.

Figure 9:
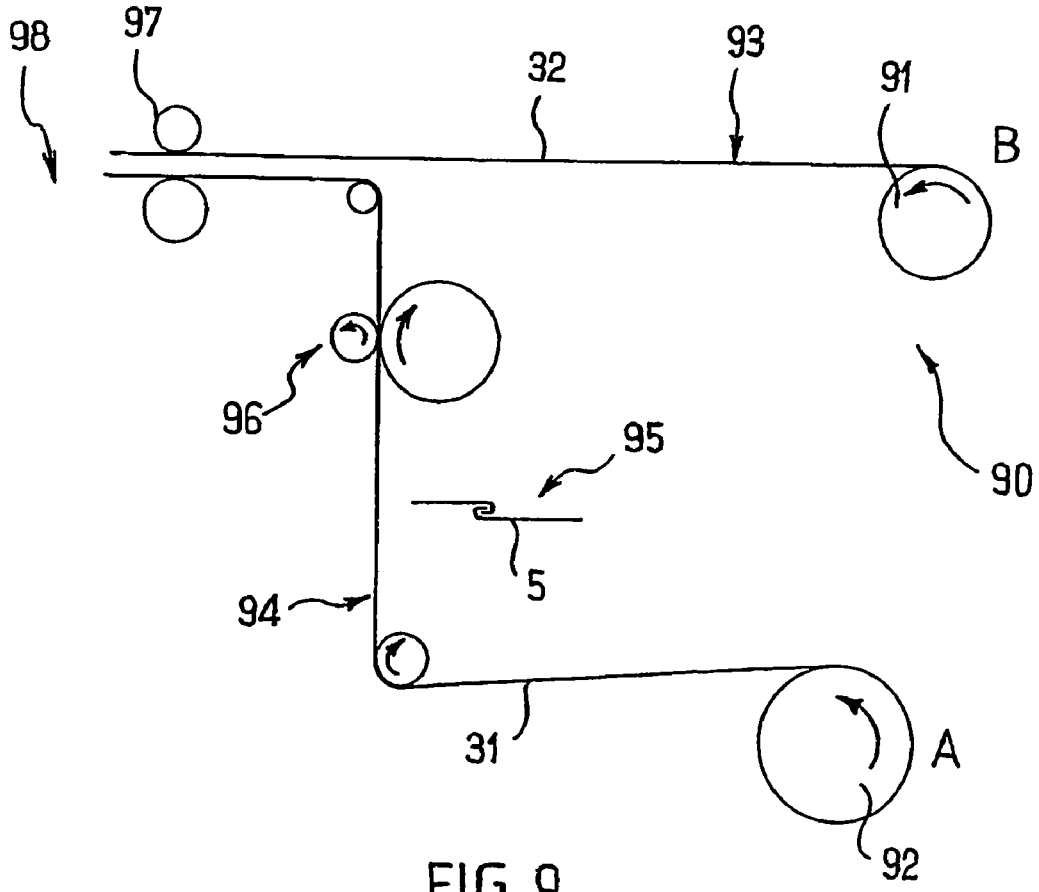
FIG. 9 diagrammatically represents a machine assembly allowing to attach means for sealing and to manufacture double ply bags.

FIG. 9 diagrammatically represents a machine allowing, to perform the method of forming and manufacturing bags according to the invention. A first packaging web 31 is reeled off a paper roller 92. In step 94, a window patch is pierced or pre-cut. At point 95, a set of fasteners 5 is applied perpendicular to the pierced or pre-cut window patch.

In step 96 the means for applying the set of fasteners is welded or stuck to the perimeter of the pierced or precut window patch. The step 96 can for example be carried out due to the feeding through of the web between two feed-through rollers visible in FIG. 9.

The set of fasteners is any type and does or does not comprise a runner. Simultaneous to the feeding through of the web 31, a packaging web 32 is reeled off the roller 91.

In step 93 a window patch is pierced or pre-cut to a similar size or of a different size to the pierced or pre-cut window patch at point 94, according to one embodiment (see FIGS. 3 and 4).

The web 32 continues to be reeled off so as to simultaneously arrive at point 97 with the web 31. At this step, we back the web 32 to the web 31 to obtain a double ply packaging web.

The piercing or pre-cutting of the window patches at steps 93 and 94 is synchronized, so that the window patches lie perpendicular to each other when they arrive at point 97. The step 97 can for example be carried out due to the feeding through of the webs between two feed-through rollers as shown in FIG. 9.

From point 98 methods and machines are started for lateral welding to form the bag, with or without side gussets, its filling before sealing the upper opening of the bag.

Step 98 can also comprise the piercing of the means for gripping of handle type or the attaching of straps and cords forming means for gripping. It can be carried out at a different site than that of the steps represented in FIG. 9, at times near or relatively distant.

The diagram in FIG. 9 does not whatsoever assume the position of the machine. For example, it could be a vertical or horizontal feeding through and that the applying the set of fasteners 5 can be carried out longitudinally or transversally to the feeding through of the packaging web 31.

The invention claimed is:

1. A method for manufacturing double ply packaging bags comprising:

feeding a first packaging web, the first packaging web including a window patch that is cut out or pre-cut;

feeding a second packaging web, the second packaging web including another window patch that is cut out or pre-cut;

applying a fastener assembly to the first packaging web and the second packaging web in front of the window patches of the first packaging web and the second packaging web, the fastener assembly comprising side films for attaching the fastener assembly to the first packaging web or the second packaging web;

attaching the fastener assembly onto the first packaging web the side films for attaching the fastener assembly being incorporated between the two packaging webs or the second packaging web;

attaching the two packaging webs to each other to form a double ply web, the fastener assembly being located inside the double ply web, and forming a double ply packaging bag with the double ply web, the double ply packaging bag having a front wall and a back wall, the front wall and the back wall each being formed by the double ply web.

2. The method set forth in claim 1, wherein the fastener assembly is attached onto the first packaging web and the second packaging web, the side films for attaching the fastener assembly being incorporated between the two packaging webs.

3. The method set forth in claim 1, wherein the fastener assembly is attached only to one of the first packaging web and the second packaging web, the other of the first packaging web and the second packaging web not covering the side films for attaching the fastener assembly.

4. The method set forth in claim 1, claim 2 or claim 3, wherein the side films for attaching fastener assembly are welded to the first packaging web or the second packaging web.

5. The method set forth in claim 1 or claim 2, wherein the side films for attaching the fastener assembly are stuck to the first packaging web or the second packaging web.

6. The method set forth in claim 1, wherein cutting the window patch of the first packaging web and the window patch of the second packaging web is synchronized so that the window patch and the other window patch lie opposite each other when the subsequent joining of the first and second packaging webs in order to form the double ply web.

7. The method set forth in claim 1, wherein the window patch of the first packaging web is intended for an external wall of the double ply packaging bag with a pre-cut dotted line, and the external wall of the double ply packaging bag is capable of forming a seal covering the fastener assembly on a front of the double ply packaging bag and being of tamper-proof type prior to the first opening.

8. The method set forth in claim 1, wherein the window patch of the second packaging web is intended for an internal wall of the double ply packaging bag with a pre-cut dotted line, and the internal wall of the double ply packaging bag is capable of forming a seal covering the fastener assembly on an inside of the double ply packaging bag and being of tamper-proof type prior to the first opening.

9. The method set forth in claim 1, further comprising:

attaching an adhesive strip opposite the window patch of an external wall of the first packaging web, this strip thus constituting a tamper-proof element to be stripped off upon the first opening of the double ply packaging bag.

10. The method set forth in claim 1, wherein double ply packaging bags are formed by folding the double ply web on itself.

11. The method set forth in claim 1, wherein the double ply web is folded in order to obtain gussets on the sides of the double ply packaging bag.

12. The method set forth in claim 1, wherein the fastener assembly is positioned transversally in relation to the feed through direction of a packaging web.

13. The method set forth in claim 1, wherein the fastener assembly is positioned longitudinally in relation to the feed through direction of a packaging web.

14. The method set forth in claim 1, wherein the fastener assembly comprises a runner facilitating the opening and the closing of the fastener assembly.

15. The method set forth in claim 1, wherein the fastener assembly comprises complementary sealing sections.

16. The method set forth in claim 1, wherein the fastener assembly comprises a sealing film located towards the outside or inside of the double ply packaging bag, and covering the means for sealing the fastener assembly, so that said film constitutes a tamper-proof element prior to the first opening of the double ply packaging bag.

17. The method set forth in claim 16, wherein the sealing film comprises a line of weakness capable of being torn upon the first opening of the double ply packaging bag.

18. The method set forth in claim 1, wherein at least one of the first packaging web and the second packaging web is made of plastic material.

19. The method set forth in claim 1, wherein at least one of the first packaging web and the second packaging web is made of paper material.

20. The method set forth in claim 1, wherein at least one of the first packaging web and the second packaging web is made of carton material.

21. The method set forth in claim 1, wherein the double ply packaging web is formed and filled with a Form, Fill, Seal (FFS) method.

22. The method set forth in claim 1, wherein an opening is made forming a handle at the top of the double ply packaging bag.

23. The method set forth in claim 1, wherein at least a grip strap is attached forming a handle at the top of the double ply packaging bag.

* * * * *

UNITED STATES PATENT AND TRADEMARK OFFICE

CERTIFICATE OF CORRECTION

PATENT NO. : 7,340,870 B2
APPLICATION NO. : 10/504045
DATED : March 11, 2008
INVENTOR(S) : Roger It is certified that error appears in the above-identified patent and that said Letters Patent is hereby corrected as shown below:

Column 6, lines 8-9, please delete "the side films for attaching the fastener assembly being incorporated between the two packaging webs".

Column 6, line 10, after "web;" please insert -- the side films for attaching the fastener assembly being incorporated between the two packaging webs; --

Signed and Sealed this

Thirtieth Day of September, 2008

JON W. DUDAS
*Director of the United States Patent and Trademark Office*